United States Patent [19]

Mitsukuchi et al.

[11] Patent Number: 4,723,058

[45] Date of Patent: Feb. 2, 1988

[54] GAS SWITCH

[75] Inventors: Kunio Mitsukuchi; Isamu Eguchi; Fumio Ito; Hiromitsu Ito; Masahide Takesita; Takashi Furuhata, all of Inuyama, Japan

[73] Assignee: Takamatsu Electric Works, Ltd., Inuyama, Japan

[21] Appl. No.: 824,325

[22] Filed: Jan. 30, 1986

[30] Foreign Application Priority Data

Sep. 27, 1985 [JP] Japan ..... 60-148603

[51] Int. Cl.[4] ..... H01H 33/60; H01H 33/42

[52] U.S. Cl. ..... 200/148 F; 200/148 R; 200/308

[58] Field of Search ..... 200/148 F, 148 R, 308

[56] References Cited

U.S. PATENT DOCUMENTS 4,442,329 4/1984 Gray et al. ..... 200/148 R

*Primary Examiner*—Robert S. Macon

*Attorney, Agent, or Firm*—Jordan and Hamburg

[57] ABSTRACT

The present invention relates to a gas switch provided with a body case wherein a switching unit is installed and an arc-extinguishing gas such as sulfur hexafluoride (SF6) or the like is enclosed at a constant pressure, and an actuating mechanism for operating the switching unit. When a pressure of the arc-extinguishing gas comes lower than a predetermined value, a lock member is disposed to a working position whereat it engages with the actuating mechanism, the actuating mechanism is thus locked unoperatably, and a display member is ready for observing externally in accordance with a shift of the lock member. Operators then carry out works for maintenance and check of the gas switch as ensuring the state wherein a gas pressure drops in the body case and the actuating mechanism has been locked.

26 Claims, 22 Drawing Figures

GAS SWITCH

BACKGROUND OF THE INVENTION

1. Field of the Invention

The invention relates to a gas switch provided with a body case wherein a switching unit is installed and an arc-extinguishing gas such as sulfur hexafluoride ($SF_6$) or the like is enclosed at a constant pressure, and an actuating mechanism for operating the switching unit, and is particularly concerned with an apparatus for locking the actuating mechanism unoperatably when a pressure of the arc-extinguishing gas comes lower than a predetermined value and also for indicating a locked state resulting from the gas pressure drop.

2. Description of the Prior Art

Generally in this kind of gas switch, when a pressure of the arc-extinguishing gas comes lower than a predetermined value, a load switching capacity in the switching unit deteriorates to cause a fault according to circumstances. It is therefore necessary that the actuating mechanism be locked to avoid a danger due to an erroneous operation when the gas pressure drops. There is then proposed hitherto an apparatus wherein a lock member is disposed within an accommodating box installed on an outside of the body case, and the actuating mechanism is locked by the lock member at the time of gas pressure drop. However, according to such conventional apparatus, the lock member engages with a part of the actuating mechanism in the accommodating box, therefore the engaging state cannot be ensured externally. Accordingly, it is not definite whether a locked state of the actuating mechanism is caused by a gas pressure drop or other reason such as trouble on the mechanism or the like, thus leaving a problem that a working efficiency at the time of maintenance and check deteriorates.

SUMMARY OF THE INVENTION

A principal object of the invention is to provide a gas switch wherein a locked state of an actuating mechanism due to a gas pressure drop can be ensured externally on a display member interlocking with a lock member.

An additional object of the invention is to provide a gas switch provided with a display member which can easily be ensured externally.

Another object of the invention is to provide a gas switch which is capable of protecting a lock mechanism and a display mechanism securely from dust and rain water.

A further object of the invention is to provide a gas switch for which a lock mechanism and a display mechanism can be constituted simply and compactly.

Still a further object of the invention is to provide a gas switch wherein a temperature change is not to lead to an erroneous operation.

To attain each object mentioned above, in the first viewpoint of the invention, the gas switch comprises a body case in which a switching unit is installed and an arc-extinguishing gas such as sulfur hexafluoride and the like is enclosed at a constant pressure, a case member installed on an outside of the body case, an actuating mechanism for operating the switching unit, a lock member supported on the case member and locking the actuating mechanism unoperatably at a working position engaging with the actuating mechanism, an operating member for shifting the lock member toward the working position when the arc-extinguishing gas pressure comes lower than a predetermined value, and a display member provided engagably on the lock member and carrying out a display coresponding to the working position of the lock member externally of the case member.

In the second viewpoint of the invention, the gas switch comprises a body case in which a switching unit is installed and an arc-extinguishing gas such as sulfur hexafluoride or the like is enclosed at a constant pressure, a control handle mounted on an outside of the body case for operating the switching unit, an indicator for indicating an on or off state of the switching unit on an outside of the body case as interlocking with an operation of the control handle, a case member installed on an outside of the body case with a through hole provided near the indicator, a display plug mounted detachably to the case member through the through hole, a metallic bellows provided within the body case which is expandable according to a change in pressure of the arc-extinguishing gas, an operating member shiftable in the case member as interlocking with an expansion of the bellows, a lock member supported shiftably to the case member, accommodated normally in the case member opposite to the display plug by engaging with the operating member, projecting the display plug externally of the case member from the through hole by disengaging with the operating member according to an expansion of the bellows at the time of gas pressure drop, disposed at a working position for locking the control handle unoperatably through the indicator.

In the third viewpoint of the invention, the gas switch comprises a body case wherein a switching unit is installed and an arc-extinguishing gas such as sulfur hexafluoride or the like is enclosed at a constant pressure, an actuating mechanism for operating the switching unit, a metallic bellows provided on the body case and expandable according to a change in pressure of the arc-extinguishing gas, a case member installed externally of the body case near the bellows and accommodating a part of the actuating mechanism therein, an operating member provided shiftably within the case member as interlocking with an expansion of the bellows, a lock member supported shiftably to the case member and locking the actuating mechanism unoperatably by shifting to a working position engaging with a part of the actuating mechanism according to a shift of the operating member when the arc-extinguishing gas pressure comes below a predetermined value, a cylindrical member mounted on an outside of the case member near the lock member and consisting of a transparent material with its end surface on mounting side opened opposite to a through hole formed in the case member, a display fixed in the cylindrical member so as to form a predetermined gap with an inside wall surface of the cylindrical member, a shutter member coupled moveably to the lock member together therewith, positioned normally in the gap in the cylindrical member to cover an outside of the display, positioned outside the gap to expose the outside of the display externally through the transparent cylindrical member when the lock member is disposed at the working position.

In the fourth viewpoint of the invention, the gas switch comprises a body case wherein a switching unit is installed and an arc-extinguishing gas such as sulfur hexafluoride or the like is enclosed at a constant pressure, an actuating mechanism for operating the switching unit, a metallic bellows provided on the body case and expandable according to a change in pressure of the arc-extinguishing gas, a cover member mounted hermetically on an outside of the body case at a position corresponding to the bellows, an operating member provided moveably within the cover member as interlocking with an expansion of the bellows, a rotating shaft inserted rotatably in the cover member and provided with an engaging part for engaging with the operating member according to a one-way rotation, a spring member for energizing the rotating shaft in the one way all the time, a lock member provided on the rotating shaft externally of the cover member, locking the actuating mechanism unoperatably by shifting to a working position whereat the lock member engages with the actuating mechanism according to a rotation of the rotating shaft in the one way from being energized by the spring member when the operating member is disengaged with the engaging part according to a shift of the operating member when the arc-extinguishing gas pressure comes lower than a predetermined value.

In the fifth viewpoint of the invention, the gas switch comprises a body case wherein a switching unit is installed and an arc-extinguishing gas such as sulfur hexafluoride or the like is enclosed at a constant pressure, an actuating mechanism for operating the switching unit, a metallic bellows provided on the body case and expandable according to a change in pressure of the arc-extinguishing gas, a cover member mounted hermetically on an outside of the body case at a position corresponding to the bellows, a case member installed almost hermetically on one outside of the body case so as to acommodate the cover member and a part of the actuating mechanism therein, an operating member provided movably within the cover member as inter-locking with an expansion of the bellows, a rotating shaft supported rotatably through the cover member so as to have both the end portions projected externally of a side wall of the cover member and provided with an engaging part for engaging with the operating member according to a rotation in the one way, a spring member for energizing the rotating shaft in the one way all the time, a lock member fixed on one end portion of the rotating shaft within the case member, locking the actuating mechanism unoperatably by shifting to a working position whereat the lock member engages with a part of the actuating mechanism according to a rotation of the rotating shaft in the one way from being energized by the spring member when the operating member is disengaged with the engaging part according to a shift of the operating member when the arc-extinguishing gas pressure comes lower than a predetermined value, a display fixed on another end portion of the rotating shaft at a position coming close to an inside of the case member side wall and having a display color corresponding to the working position of the lock member on one side opposite to the inside of the side wall, a through hole formed in the case member at a position opposite to the display and exposing the display color of the display externally according to a rotation of the rotating shaft.

Other and further objects of the invention will become obvious upon understanding of the illustrative embodiments to be described hereinlater or will be indicated in the appended claims, and various advantages not referred to specifically herein will occur to one skilled in the art upon employment of the invention in practice.

BRIEF DESCRIPTION OF THE DRAWINGS

FIG. 1 to FIG. 5 represent a first operative example embodying the invention, wherein FIG. 1 is a general front view of a gas switch, FIG. 2 is a longitudinal sectional view of a lower end portion of the gas switch for illustrating a construction of a lock mechanism chiefly, FIG. 3 is a sectional view taken on line III—III of FIG. 2 showing a lock mechanism and a display mechanism, FIG. 4 is a sectional view taken on line IV—IV of FIG. 2 showing a relation on how a locking bar interlocks with an actuating rod, and FIG. 5 is a sectional view taken on line V—V of FIG. 2 showing a construction for supporting a display plug in suspension.

FIG. 6 to FIG. 8 represent a second operative example embodying the invention, wherein FIG. 6 is a fragmentary sectional plan view of a gas switch showing a lock mechanism and a display mechanism when a gas pressure works normally, FIG. 7 is a sectional plan view corresponding to FIG. 6 when a gas pressure drops, and FIG. 8 is a sectional view taken on line VIII—VIII of FIG. 6 showing a construction for mounting a microswitch.

FIG. 9 to FIG. 13 represent a third operative example embodying the invention, wherein FIG. 9 is a fragmentary sectional plan view of a gas switch showing a lock mechanism and a display mechanism when a gas pressure works normally, FIG. 10 is a sectional view taken on line X—X of FIG. 9, FIG. 11 is a side view, partly broken, showing a construction on how a locking bar interlocks with a display member, FIG. 12 is a perspective view showing a construction for how to fit a locking member to a locking bar, and FIG. 13 is a sectional view taken on line XIII—XIII of FIG. 9 showing a construction for supporting a locking bar to a bearing member.

FIG. 14 to FIG. 19 represent a fourth operative example embodying the invention, wherein FIG. 14 is a sectional front view showing an actuating mechanism when a gas pressure works normally by breaking a case member on an upper portion of the gas switch, FIG. 15 is a sectional view taken on line XV—XV of FIG. 14, FIG. 16 is a perspective view showing the actuating mechanism in a closed state, FIG. 17 is a sectional view taken on line XVII—XVII of FIG. 14, FIG. 18 is a sectional view taken on line XVIII—XVIII of FIG. 17, and FIG. 19 is a sectional front view showing the actuating mechanism with a lock member disposed at a working position when a gas pressure drops.

FIG. 20 to FIG. 22 represent a fifth operative example embodying the invention, wherein FIG. 20 is a general perspective view of a gas switch for construction work, FIG. 21 is a general front view thereof, and FIG. 22 is a sectional view showing a lock mechanism which is taken on line XXII—XXII of FIG. 21.

DETAILED DESCRIPTION OF THE PREFERRED EMBODIMENTS

(First Example)

Figure 1:
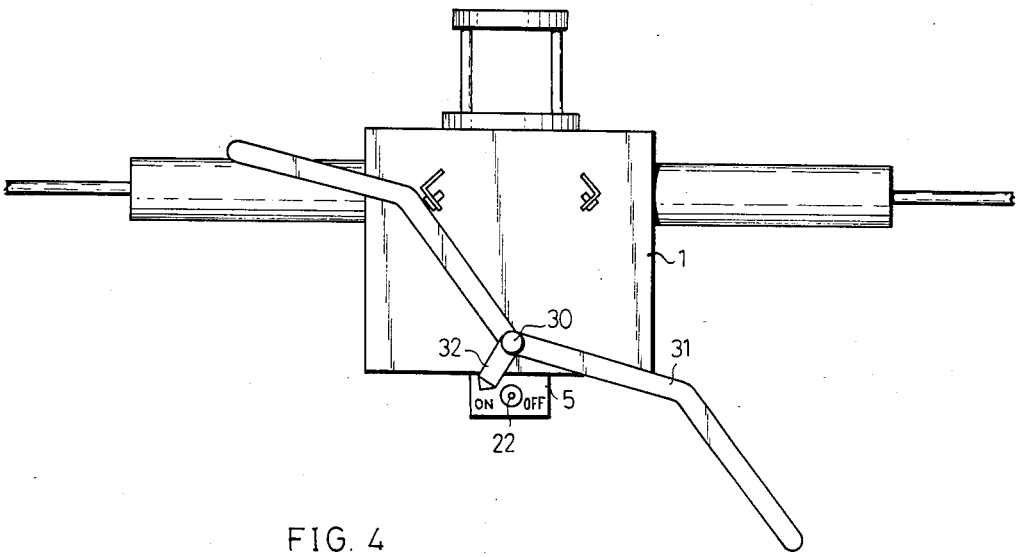
Figure 2:
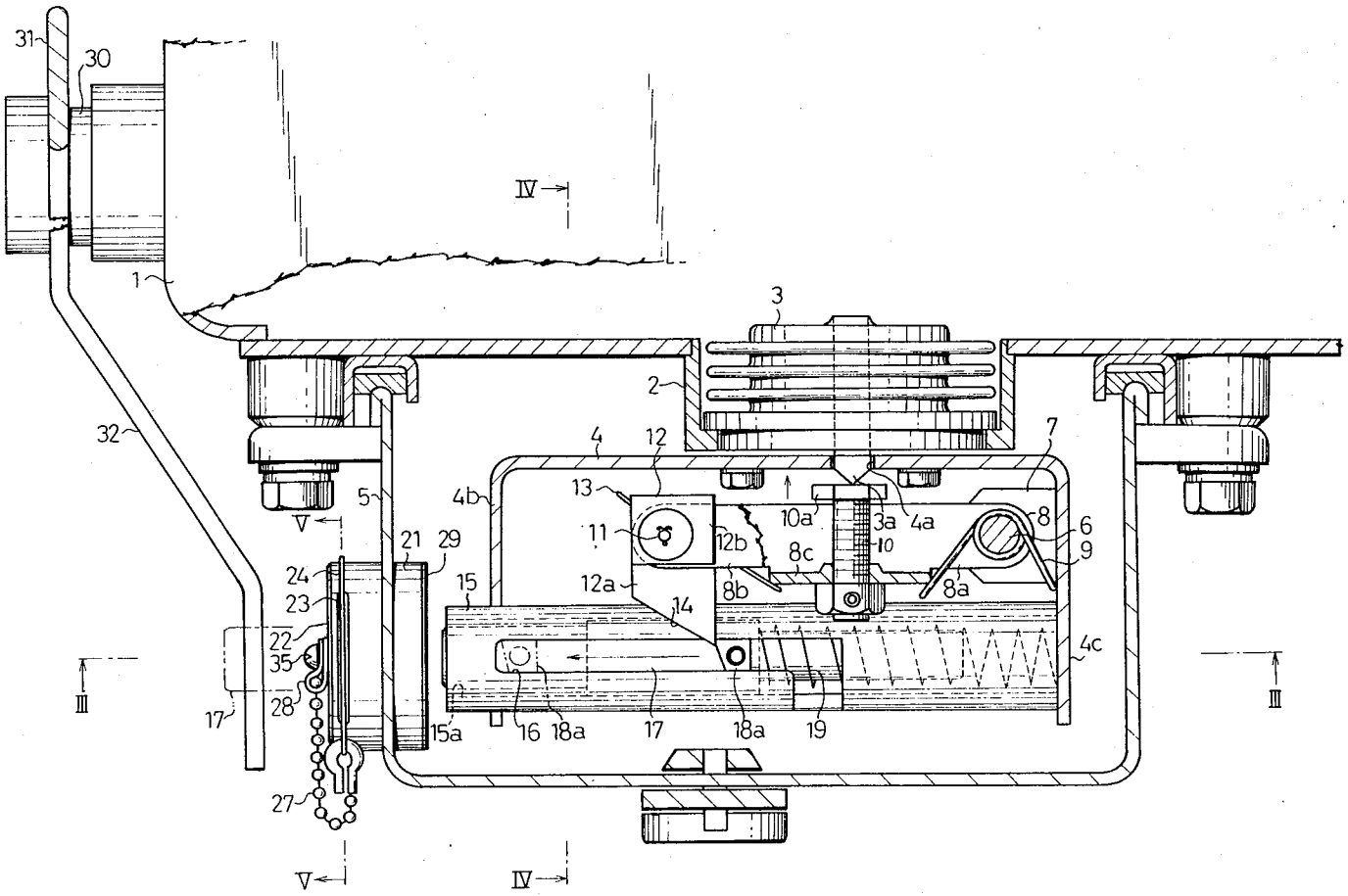

A first example embodying the invention will now be described with reference to FIG. 1 to FIG. 5. A plurality of switching units (not indicated) are provided within a body case 1 of leakproof structure, and also an arc-extinguishing gas such as sulfur hexafluoride ($SF_6$) or the like is enclosed at a constant pressure therein. As shown in FIG. 1 and FIG. 2, there is mounted an enclosing box 5 as case member airtightly on a front lower portion of the body case 1. An enclosing cylinder 2 is fixed projectingly into the enclosing box 5 at its upper end on a lower surface of a bottom wall of the body case 1. A metallic bellows 3 expandable according to a fluctuation of an arc-extinguishing gas pressure in the body case 1 is enclosed airtightly within the enclosing cylinder 2. A mounting member 4 provided with drooping parts 4b, 4c on both side edges longitudinally is fixed on a lower end of the enclosing cylinder 2, and a through hole 4a for projecting an operating rod 3a with its one end fixed in the bellows 3 downward is formed at the central portion.

Figure 4:
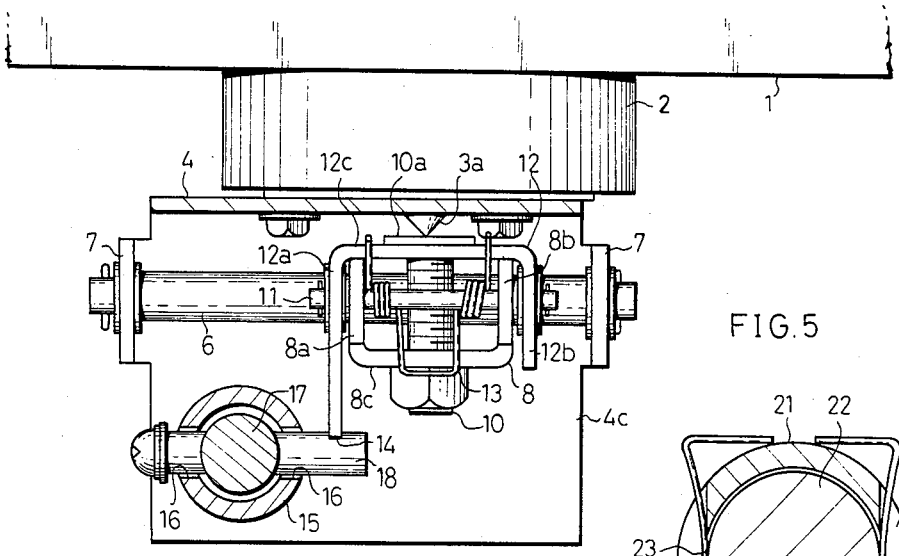
Figure 3:
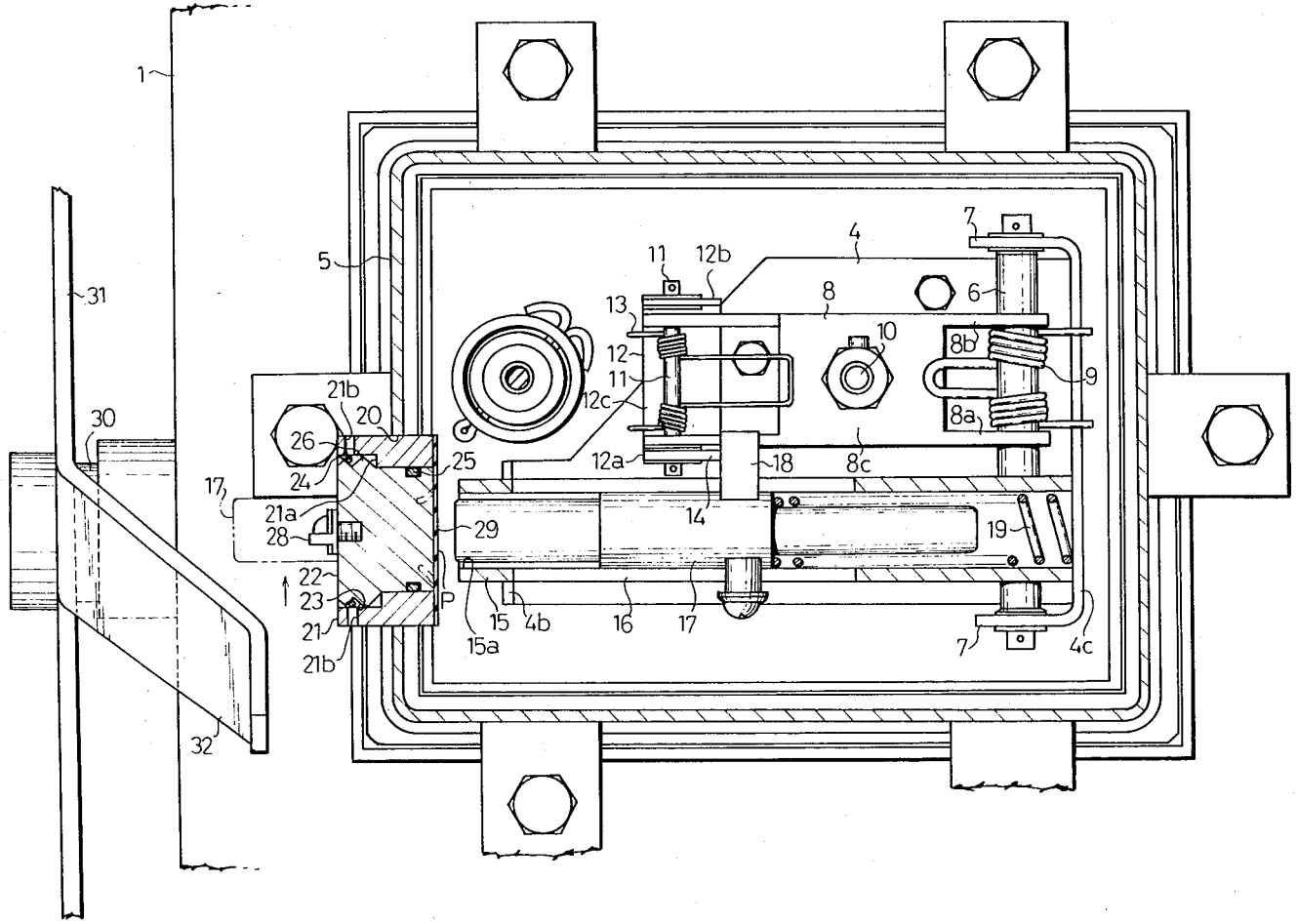

As shown in FIG. 2 and FIG. 3, the rearward drooping part 4c of the mounting member 4 is provided with support pieces 7 paired horizontally, and a bearing shaft 6 is laid between both the support pieces 7. An operating member 8 is supported rotatably on the bearing shaft 6 at the rear end portion. The operating member 8 is constituted of side plates 8a, 8b paired horizontally and a coupling plate 8c for coupling lower ends at the central portions each. A helical double torsion spring 9 for energizing the operating member 8 clockwise in FIG. 2 is installed on the bearing shaft 6 between both the side plates 8a, 8b. A screw rod 10 as adjusting member is screwed in the coupling plate 8c of the operating member 8 to project upward, and a contact part 10a coming in contact with a lower end of the operating rod 3a of the bellows 3 on a force energized by the torsion spring 9 is provided on an upper end thereof. As shown in FIG. 2, FIG. 3 and FIG. 4, a shaft 11 is laid between front end portions of both the side plates 8a, 8b in the operating member 8, and a locking piece 12 formed like a channel of a pair of side plates 12a, 12b and a coupling plate 12c for coupling the two is supported rotatably on the shaft 11. A helical double torsion spring 13 is installed on the shaft 11 between both the side plates 12a, 12b the locking piece 12 is energized by the spring force clockwise in FIG. 2, and thus the coupling plate 12c is normally kept in contact and so retained with an upper surface of both the side plates 8a, 8b of the operating member 8. One side plate 12a of the locking piece 12 is formed longer downward than the other side plate 12b, and a guide plane 14 is formed slantingly on its lower end.

A guide cylinder 15 is fixed on the drooping part 4c rearward of the mounting member 4 at the rear end thereof so as to extend forward almost in parallel with the operating member 8, an opening 15a is formed on its front end, and an elongated aperture 16 is perforated axially in both sides thereof. A locking bar 17 is inserted slidably in the guide cylinder 15 as kept energized forward by a helical compression spring 19. An engaging pin 18 is passed through the central portion of the locking bar 17 orthogonally to its axis, and both side projections are fitted in each elongated aperture 16 of the guide cylinder 15. As shown in FIG. 2, one projection 18a of the engaging pin 18 is engagable with a lower end portion of the one side plate 12a of the locking piece 12, and when the locking bar 17 is enclosed almost entirely in the guide cylinder 15, the projection 18a engages from rearward with the rear side of a lower end portion of the side plate 12a in opposition to a force energized by the compression spring 19, thus holding the locking bar 17 at an inoperative position. Then, when the side plate 12a and the projection 18a are disengaged, the locking bar 17 protrudes forward to move to a position whereat the projection 18a and a front end of the elongated aperture 16 engage according to a force energized by the spring 19 as indicated by a chain line in FIG. 2, and is thus disposed to a working position.

Figure 5:
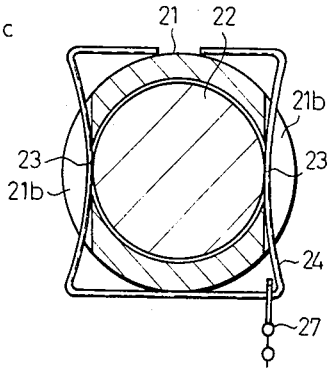

As shown in FIG. 3, a mounting hole 20 is perforated in a front side wall of the enclosing box 5 at a position corresponding to the direction in which the locking bar 17 protrudes, and a display cylinder 21 is fixed airtightly in the mounting hole 20. The display cylinder 21 is provided with a stepped part 21a on its inner peripheral surface and also a pair of kerfs 21b opposite each other on the front end circumferential wall. A display plug 22 is fitted from the front in the display cylinder 21, which is stopped from coming off by an O-ring 25. A recession 23 and a protrusion 26 engaging with the stepped part 21a of the display cylinder 21 are formed on the outer peripheral surface of a front end portion of the display plug 22. As shown in FIG. 5, a square annular linear spring 24 is installed on the outer periphery of a front end portion of the display cylinder 21, and its both side portions are locked elastically in the kerfs 21b of the display cylinder 21 and the recession 23 of the display plug 22. A chain 27 is mounted on a part of the linear spring 24 at its one end, and the other end is locked on the front of the display plug 22, as shown in FIG. 2, through a mounting piece 28 and a screw 35.

A closing film 29 consisting of rubber or the like is fixed on a rear end surface of the display cylinder 21 positioned within the enclosing box 5. A multitude of fragile grooves are formed radially on the closing film 29, and when the locking bar 17 protrudes forward, the closing film 29 is fractured at each groove, and a multitude of cut pieces of the closing film 29 then come close to an outer peripheral surface of the locking bar 17 as indicated by a chain line in FIG. 3, thus preventing rain water and others from coming thereinto. Then, a display color P such as red and others is colored on a rear side of the display plug 22 opposite to the closing film 29.

An operating shaft 30 constituting a part of the actuating mechanism for opening and closing a plurality of the switching units in the case 1 is protruded in front of the body case 1, and as shown in FIG. 1 to FIG. 3, a handle 31 is fixed on the front end at the central portion, and an indicator 32 for indicating ON-OFF of the switch is also fixed thereon to interlock with the handle 31.

A tip of the indicator 32 is engagable with a nose of the locking bar 17 sidewise, and the handle 31 cannot be operated when the indicator 32 engages with the locking bar 17.

An action of the gas switch constituted as above will be described next.

FIG. 1 and FIG. 2 then illustrate an unlocked state wherein pressure of the arc-extinguishing gas in the body case 1 is normal and thus the handle 31 is ready for operating. In such state, the projection 18a of the locking bar 17 is locked to a lower end portion of the one side plate 12a of the locking piece 12, which is ready for enclosing the locking bar 17 almost entirely in the guide cylinder 15, and the display plug 22 is fitted in the display cylinder 21.

In the unlocked state when a gas pressure in the body case 1 comes lower than a predetermined value, the bellows 3 elongates according to a difference between atmospheric pressure and internal pressure, and the operating rod 3a ascends. With the operating rod 3a engaged with the contact part 10a of the screw rod 10, the operating member 8 is rotated clockwise of FIG. 2 on a force energized by the torsion spring 9. When the locking piece 12 ascends according to a rotation of the operating member 8, the lower end portion of the one side plate 12a and the projection 18a of the locking bar 17 are disengaged. Thus, the locking bar 17 protrudes ahead of the guide cylinder 15 according to a force energized by the spring 19, pushes to rupture the closing film 29, and then pushes the display plug 22 externally from the display cylinder 21. With its display color P facing downward, the display plug 22 having thus come off is slung from the display cylinder 21 through the chain. Accordingly, the operator is capable of ensuring easily a gas pressure drop state of the switch through observing the display plug 22 coming off the display cylinder 21 and the protruded locking bar 17. Further, since the protruded locking bar 17 is positioned on a rotating path of the indicator 32, the handle 31 is locked unoperatably for rotation.

As described above, in the gas switch of the invention, a gas pressure drop state is indicated by three means of the protruded locking bar 17, the slung display plug 22 and the display color P of the display plug 22, therefore the operator can be acquainted securely with an occurrence of abnormity in the gas switch. Further, a construction is such that the locking bar 17 locks the indicator 32 which is most noticeable, therefore a protruded state of the locking bar 17 is not capable of being overlooked. In addition, the display plug 22 is pushed out of the display cylinder 21 simultaneously with protrusion of the locking bar 17, therefore not only a locked state is ensured but also it can be ensured that the locked state is caused by a gas pressure drop.

(Second Example)

Figure 7:
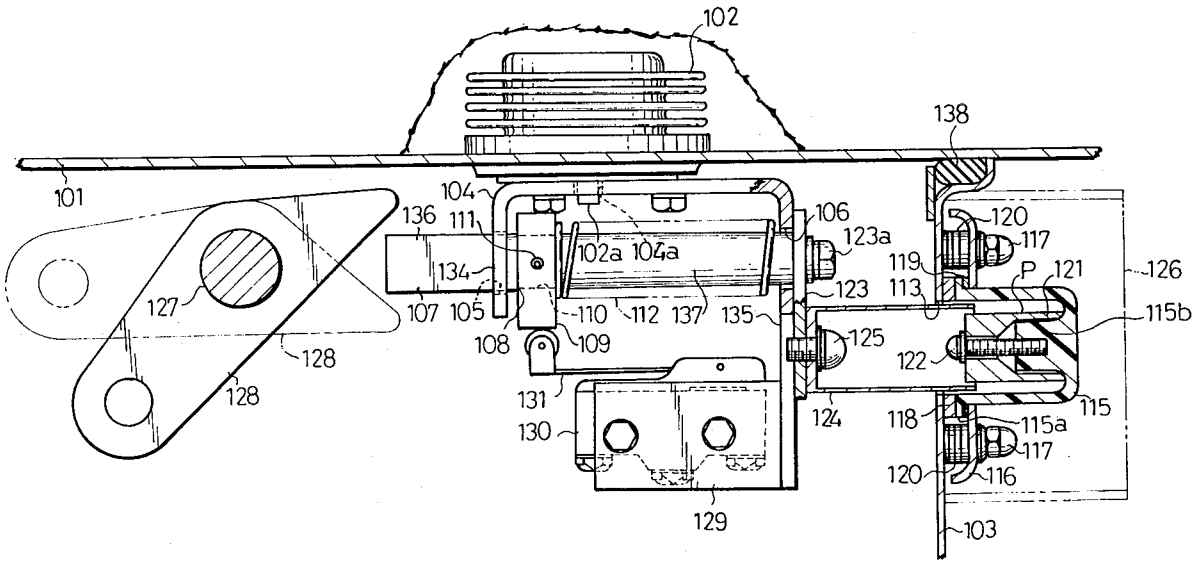
Figure 11:
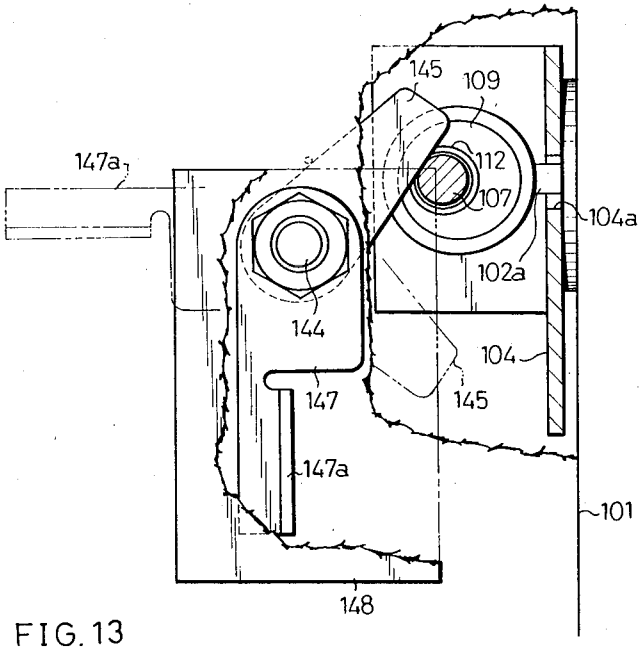
Figure 8:
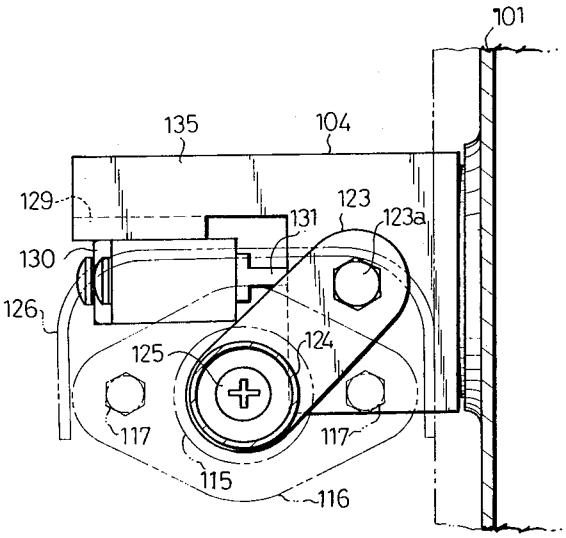

Next, a second example embodying the invention will be described according to FIG. 6 to FIG. 8.

An arc-extinguishing gas such as SF6 or the like is enclosed at a constant pressure within a body case 101 of leakproof structure. A metallic bellows 102 is mounted on the inside of a side wall of the body case 101, which is expandable according to a fluctuation of the gas pressure in the body case 101. An enclosing box 103 as case member is mounted airtightly on an outside of the body case 101 through a packing 138. A channel-like bearing member 104 is fixed on an outside of a bellows mounting plate 133 exposed within the enclosing box 103. The bearing member 104 is provided with a through hole 104a for an actuating rod 102a provided on a moving part of the bellows 102 to protrude outward. A square hole 105 is perforated in one bend 134 of the bearing member 104, and a circular hole 106 is perforated in another bend 135.

A locking bar 107 is inserted slidably in the holes 105, 106 each. The locking bar 107 has a prism part 136 fitted unrotatably in the square hole 105, a column part 137 fitted loosely in the circular hole 106, and a stepped part 108 between the prism part 136 and the column part 137. A ring locking member 109 is fitted on the locking bar 107 through an eccentric hole 110 and fixed with a screw 111 at a position engaging with the stepped part 108. A helical compression spring 112 for energizing the locking bar 107 leftward all the time in FIG. 6 is fitted on the locking bar 107 between the bend 135 of the bearing member 104 and the locking member 109.

Then, when the actuating rod 102a of the bellows 102 protrudes outward at the time of normal gas pressure, the locking member 109 is locked to the actuating rod 102a on a force of the compression spring 112, and thus the locking bar 107 is retained at an inoperative position. When the actuating rod 102a recedes according to an elongation of the bellows 102 at the time of gas pressure drop, the actuating rod 102a and the locking member 109 are disengaged, and the locking bar 107 is protruded leftward of FIG. 6 on a force of the compression spring 112 to come to a working position. A rate of the locking member 109 for engaging with the actuating rod 102a is adjusted by turning the locking member 109 eccentrically so that both the two will be disengaged when the gas pressure in the body case 101 comes lower than a predetermined value.

A mounting hole 113 is perforated in a side wall of the enclosing box 103 so as to correspond to the locking bar 107. A pair of bolts 114 are provided on an outside of the enclosing box 103 near the mounting hole 113. A covered cylindrical display cylinder 115 same in inside diameter as the mounting hole 113 which is formed of a transparent plastic resin is disposed on the outside of the enclosing box 103 so as to cover the mounting hole 113. A flange 115a formed on the outer periphery of a base end portion of the display cylinder 115 is mounted by clamping a cap nut 117 to the bolts 114 through a retainer 116 in which the display cylinder 115 and the bolts 114 are inserted. A packing 118 is interposed between the display cylinder 115 and the enclosing box 103, and a waterproofing sheet 119 is interposed between the flange 115a of the display cylinder 115 and the retainer 116, thereby closing the mounting hole 113 hermetically. Then, a plurality of spacers 120 are installed on the bolts 114 between the retainer 116 and the enclosing box 103. A canopy member 126 for covering the display cylinder 115 from over and sideways is provided on an outside of the enclosing box 103. A bottomed cylindrical display 121 is fitted in a projection 115b formed on an inside of the top of the display cylinder 115 and is fastened and fixed with a screw 122. A predetermined gap is formed between an outer peripheral surface of the display 121 and an inner peripheral surface of the display cylinder 115. The display color P such as red and others is colored on the outer peripheral surface of the display 121 for indicating a locked state.

A coupling piece 123 with its nose extending so as to face on the mounting hole 113 is fixed on an end surface to a side of the display cylinder 115 with the bolt 123a. A cylindrical display cover 124 is mounted on the nose of the coupling piece 123 with a screw 125 in such state as will come into the display cylinder 115 by way of the mounting hole 113. When the locking member 109 on the locking bar 107 engages with the actuating rod 102a of the bellows 102 at the time of normal gas pressure, a nose of the display cover 124 is positioned in the gap between the display cylinder 115 and the display 121 and thus covers the outer peripheral surface of the display 121 entirely. Then, when the locking member 109 is disengaged with the actuating rod 102a at the time of gas pressure drop, the display cover 124 shifts inward according as the locking bar 107 shifts toward a working position, as shown in FIG. 7, and thus the outer peripheral surface of the display 121 is exposed entirely in the display cylinder 115.

An operating shaft 127 is provided rotatably in reciprocation within the enclosing box 103 so as to face on a side end surface of the prism part 136 of the locking bar 107. A handle which is not particularly indicated is mounted on the operating shaft 127 externally of the enclosing box 103, a manual on-off actuating mechanism (not indicated) is actuated through the operating shaft 127 by operating the handle in reciprocation, and thus the switching units in the body case 101 are driven to operate. An interlocking lever 128 is fixed on the operating shaft 127 at the central portion extendedly of an axis of the locking bar 107. As shown in FIG. 7, when the locking bar 107 is disposed at a working position at the time of gas pressure drop, a nose of the locking bar 107 comes on a turning path of the interlocking lever 128, thereby preventing the interlocking lever 128 from turning in a closing direction or opening direction. Accordingly, the manual on-off actuating mechanism is locked unoperatably in this case.

A microswitch 130 is mounted on a lower end of the one bend 135 of the bearing member 104 through a mounting piece 129. A nose of an actuator 131 of the microswitch 130 is positioned inward of the locking member 109, and when the locking bar 107 protrudes at the time of gas pressure drop, the actuator 131 is depressed by the locking member 109, the microswitch 130 is thus turned off, and an automatic on-off actuating mechanism (not indicated) of the switch is locked unoperatably.

An action of the gas switch constituted as above will now be described.

Figure 6:
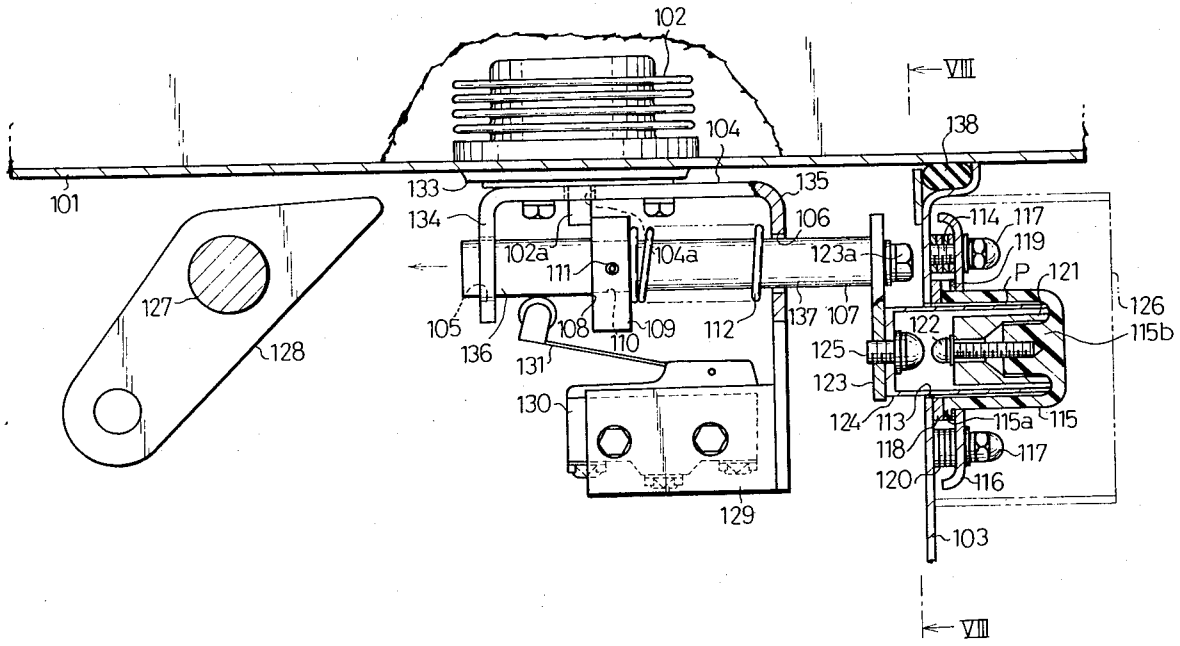

FIG. 6 shows a state where a gas pressure in the body case 101 is normal. In this state, a rotation of the interlocking lever 128 is not prevented by the locking bar 107, and the manual on-off actuating mechanism can be actuated through the operating shaft 127 by operating the control handle. Then, since the microswitch 130 is turned on, the automatic on-off actuating mechanism can also be actuated. In the unlocked state, the locking bar 107 is kept at an inoperative position through engagement of the locking member 109 and the actuating rod 102*a*, therefore the display cover 124 is disposed within the display cylinder 115, and the display color P on an outer peripheral surface of the display 121 is concealed by the display cover 124. Accordingly, the operator is capable of ensuring that the gas pressure in the body case 101 is normal by observing the display cylinder 115.

In the state where the gas pressure is normal when pressure of an arc-extinguishing gas in the body case 101 comes lower than a predetermined value, the bellows 102 elongates according to a difference between atmospheric pressure and internal pressure to shift the actuating rod 102*a* inward. Then the actuating rod 102*a* is disengaged with the locking member 109 as shown in FIG. 7, and the locking bar 107 protrudes until the coupling piece 123 comes in contact with an outside of the bearing member 104 on a force energized by the compression spring 112. A nose of the locking bar 107 thus protruded is positioned on a turning path of the interlocking lever 128, and the interlocking lever 128 becomes unrotatable to lock the manual actuating mechanism. Further, the microswitch 130 is turned off by the locking member 109, and thus the automatic on-off actuating mechanism is also locked. At the same time, the display cover 124 recedes externally of the display cylinder 115 through the coupling piece 123 according to a protrusion of the locking bar 107, and an outer peripheral surface of the display 121 is exposed entirely in the display cylinder 115. Accordingly, the operator is capable of ensuring easily that the gas pressure in the body case 101 has dropped by observing the display color P of the display 121 externally through the transparent display cylinder 115.

In the gas switch of the invention, a gas pressure when the locking mechanism and the display mechanism are actuated can be set to any selected value by rotating the locking member 109 eccentrically on the locking bar 107. Further, even in case a setting error is present among parts mutually in the locking mechanism, each part can be coordinated correctly for operation by adjusting a rotation of the locking member 109.

(Third Example)

A third example of the invention will, be described according to FIG. 9 to FIG. 13, next. In the third example, a construction of the display mechanism in the second example is changed, and therefore a construction of the locking mechanism and others remains almost same as the second example. Like reference numerals represent like members of the second example, and a further description will be omitted thereof.

A bearing 143 is fixed projectingly inward on the enclosing box 103 at a position corresponding to one end of the locking bar 107. A turning shaft 144 is supported on the bearing 143, and a lever 145 engagable with one end portion of the locking bar 107 is fixed on an inner end thereof. A helical torsion spring 146 for energizing the engaging lever 145 at all times in the direction engaging with the locking bar 107 is fitted on the bearing 143.

A plate-like display member 147 is fixed at its one end on an outer end portion of the turning shaft 144 projecting from outside of the enclosing box 103, and a display piece 147*a* is formed projectingly on the other end. The display member 147 is covered with a covering member 148 installed on the outside of the enclosing box 103.

Then, when the locking bar 107 is disposed at the inoperative position, the engaging lever 145 engages with the locking bar 107 as storing a force energized by the torsion spring 146, and the display piece 147*a* of the display member 147 is disposed at a drooping position where it does not protrude from the covering member 148. On the other hand, when the locking bar 107 is disposed at the working position at the time of gas pressure drop, the engaging lever 145 is disengaged with the locking bar 107, the turning shaft 144 is turned at about 90 degrees according to an action of the torsion spring 146, and the display piece 147*a* of the display member 147 protrudes outward of the covering member 148 as indicated by a chain line in FIG. 11. Accordingly, the operator is capable easily of ensuring the locked state due to a gas pressure drop according to the display piece 147*a*.

Figure 13:
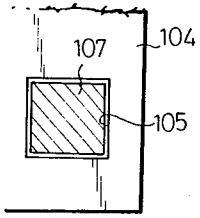
Figure 12:
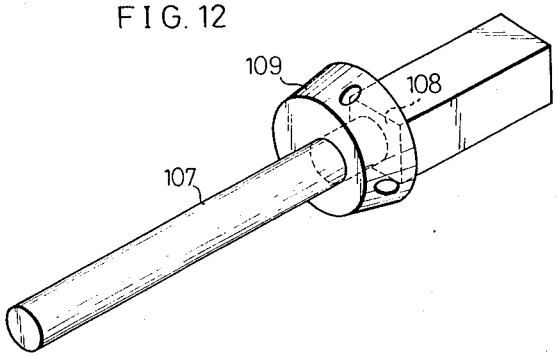
Figure 9:
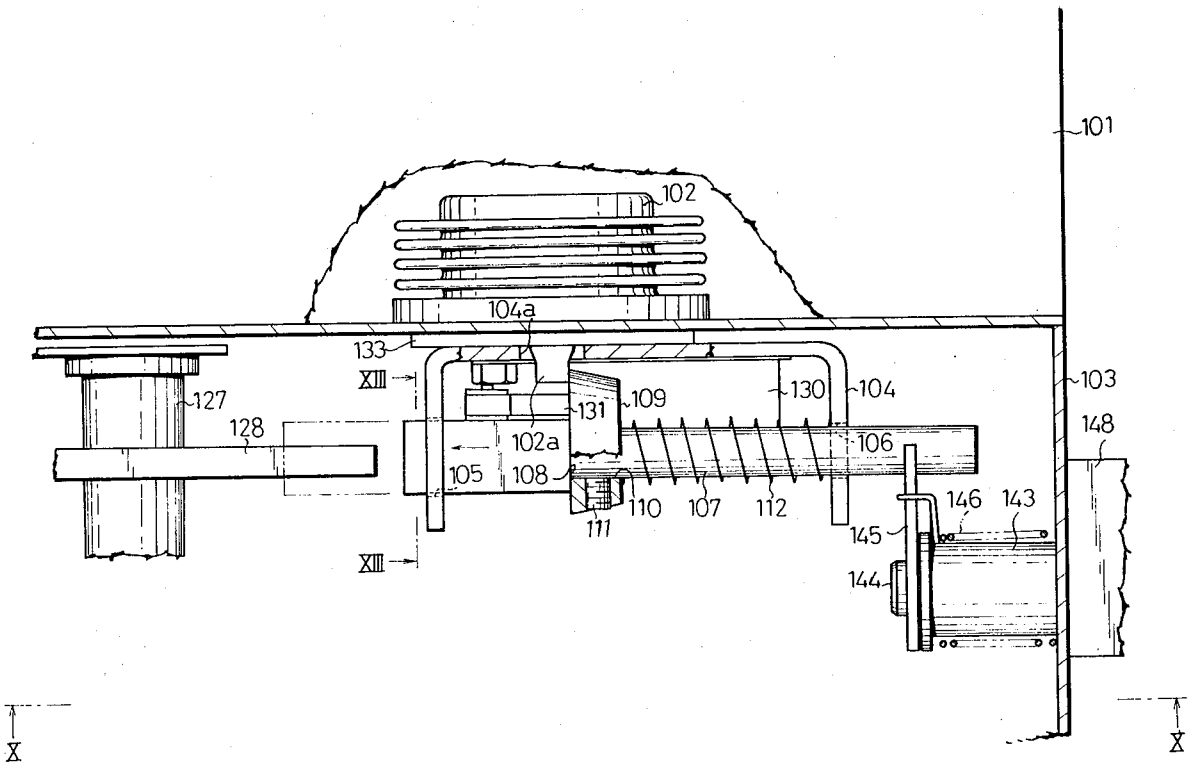
Figure 10:
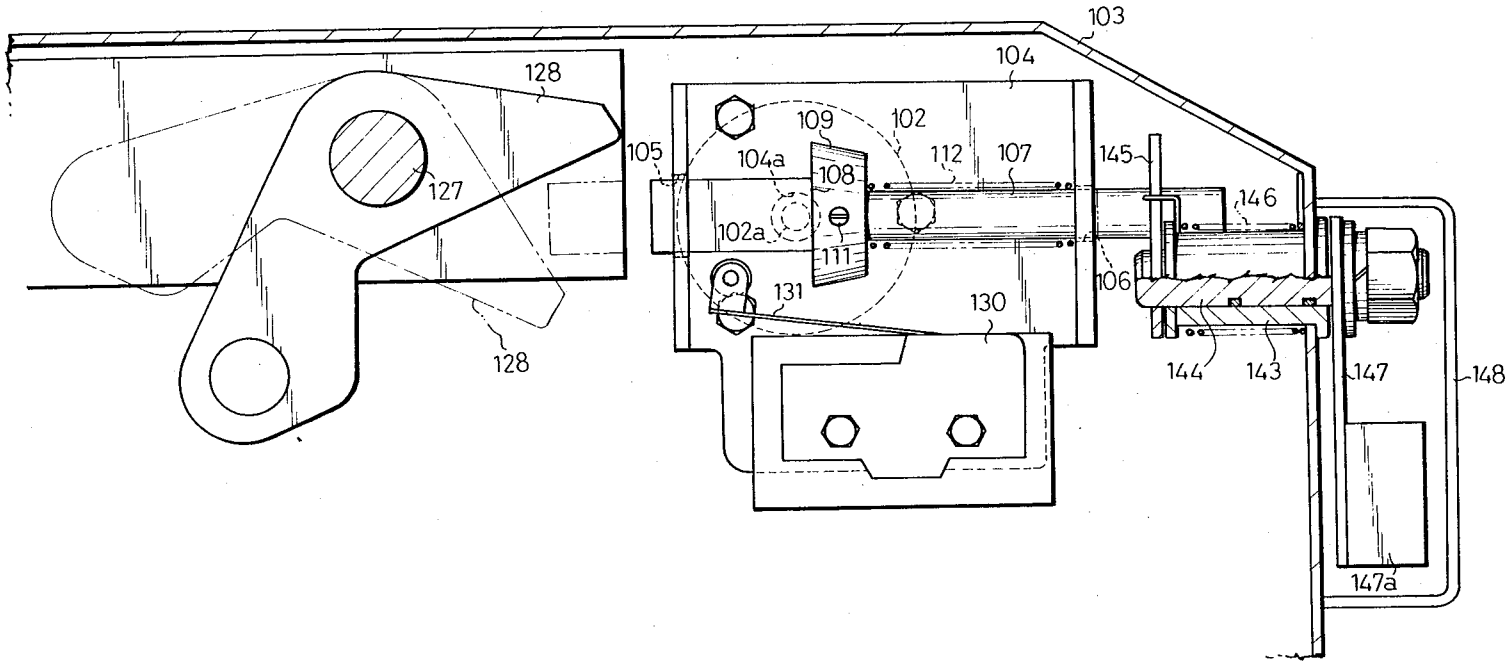

Then, FIG. 12 and FIG. 13 represent a construction for setting the locking member 109 on the locking bar 107 and a construction for supporting the locking bar 107 on the bearing member 104, respectively, and these drawings are also applicable to the second example.

(Fourth Example)

Next, a fourth example embodying the invention will be described according to FIG. 14 to FIG. 19.

Figure 14:
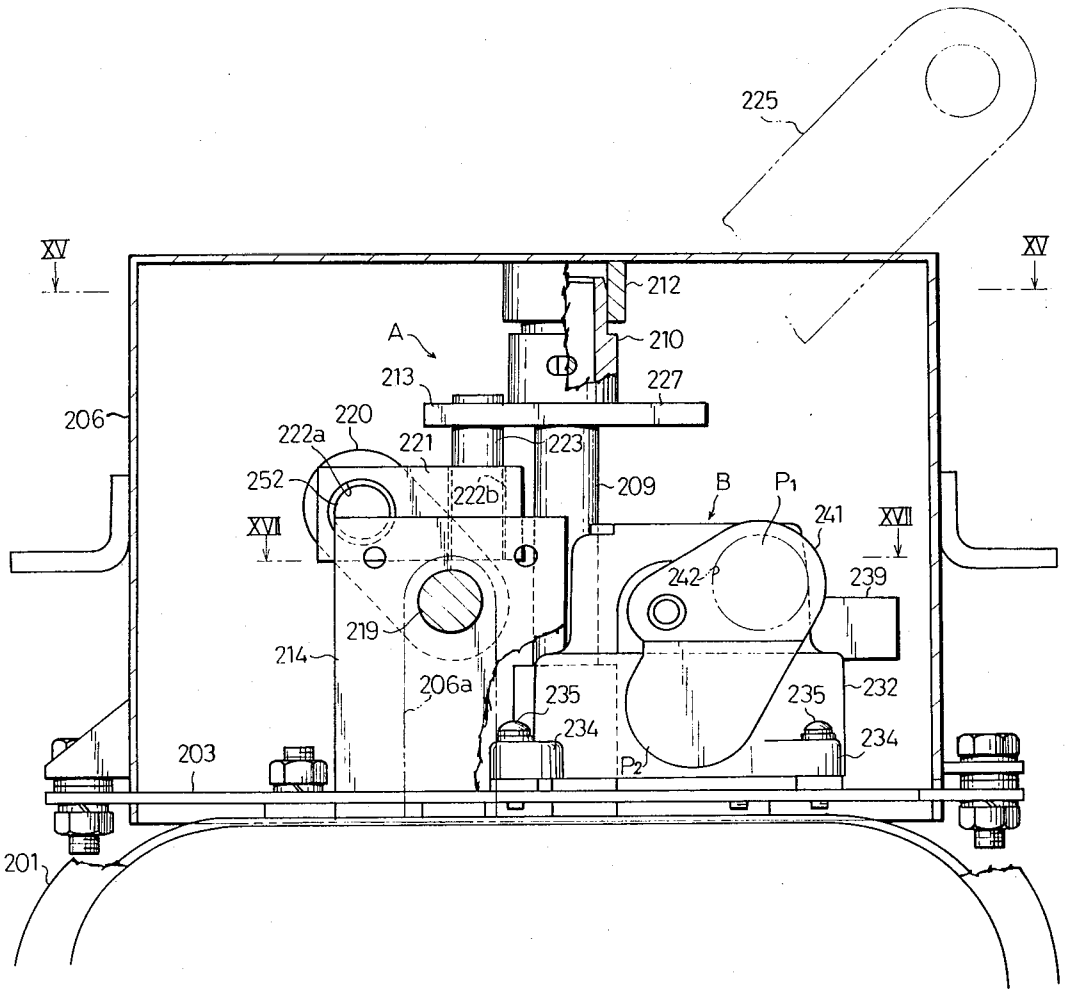
Figure 15:
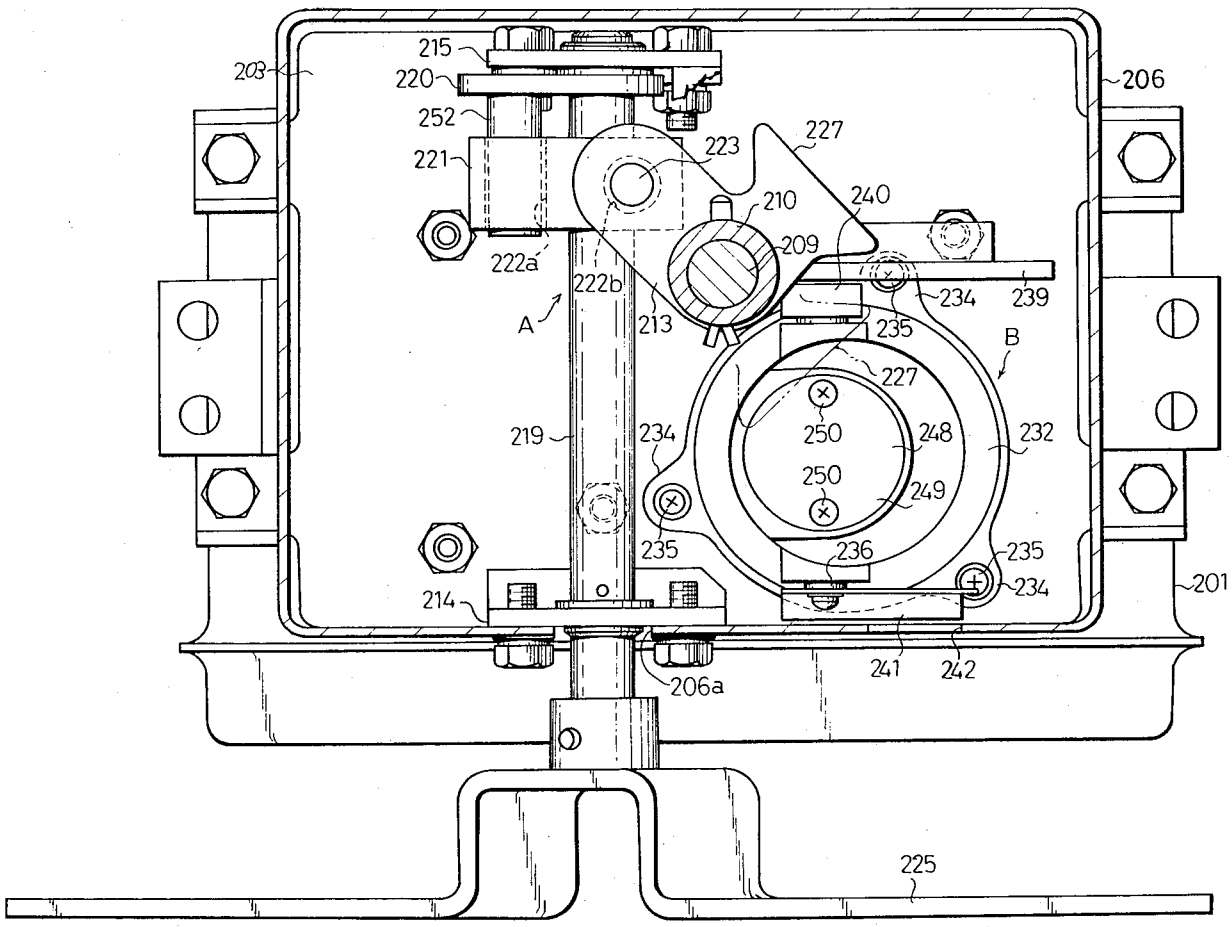
Figure 16:
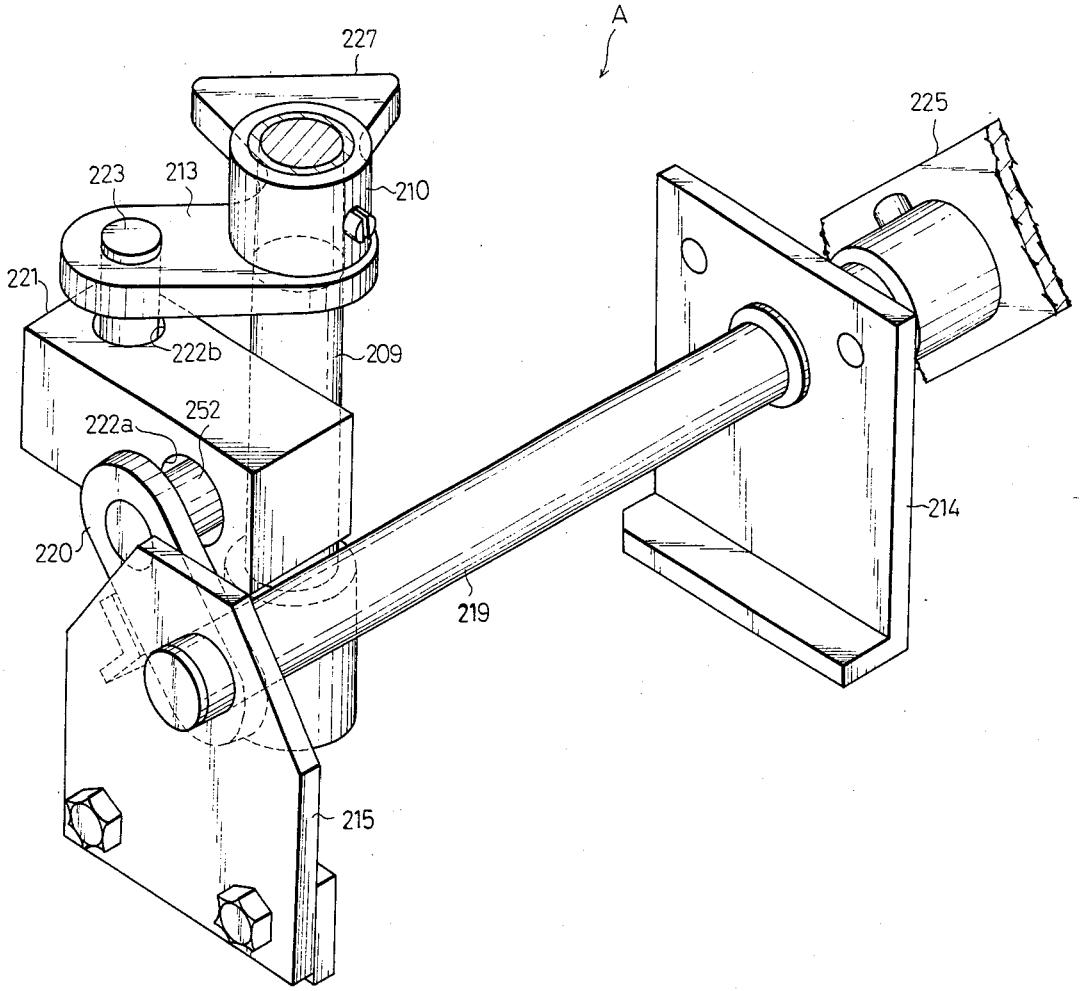

Referring first to an actuating mechanism A of the gas switch, a covered square enclosing box 206 is disposed through a support plate 203 on the top of a body case 201 enclosing an arc-extinguishing gas such as $SF_6$ or the like, as shown in FIG. 14 to FIG. 16. A driving shaft 209 for operating each phase of switching unit (not indicated) is disposed rotatably so as to extend vertically in the body case 201. An upper portion of the driving shaft 209 protrudes into the enclosing box 206 through an upper wall of the body case 201 and a through hole (not indicated) provided in the support plate 203, and its upper end is pivoted rotatably on a bearing 212 provided on the inside of an upper wall of the enclosing box 206 through a metal 210.

A driven lever 213 almost L-shaped is fixed on an upper end portion of the driving shaft 209 at the central portion, and its one end side works as an engaging projection 227 having a pair of acute-angled projections. A pin 223 protrudes downward on the lower surface of the other end portion of the driven lever 213.

A pair of support brackets 214, 215 opposite each other are fixed on a front and a rear of the support plate 203. An operating shaft 219 extending horizontally is laid rotatably between the support brackets 214, 215. A driving lever 220 is fixed on a rear end portion of the operating shaft 219 so as to face slantingly upward, and a fitting pin 252 is provided projectingly on a front of its nose portion. Inserting holes **222*a*, 222*b* are perforated orthogonally each in both end portions of a prism-like coupling link 221 disposed between the driving lever 220 and the driven lever 213, the fitting pin 252 of the driving lever 220 is inserted in the one inserting hole 222*a* and the pin 223 of the driven lever 213 is inserted in the other inserting hole 222*b* each slidably and rotatably. An inserting groove 206*a* for exposing a front end portion of the operating shaft 219 forward is cut from below on a front of the enclosing box 206. A control handle 225 is fixed on a front projection of the operating shaft 219**.

As described above, the actuating mechanism A is constituted of the operating shaft 219, the driving lever 220, the coupling link 221, the driven lever 213, the driving shaft 209 and others. Then, from turning the control handle 225 clockwise of FIG. 14, the driving lever 220 is turned in the same direction through the operating shaft 219, and the coupling link 221 is shifted rightward through the fitting pin 252. The driven lever 213 is turned clockwise of FIG. 15 through the coupling link 221 and the pin 223. Consequently, the driving shaft 209 is turned in the same direction, and each phase of switching unit in the body case 201 is closed all at once. Then, when the control handle 225 is turned counterclockwise of FIG. 14 in the closed state, each member is driven counter to the case mentioned above, and each phase of switching unit is opened all at once.

Next, a locking mechanism B provided near the driving shaft 209 of the actuating mechanism A will be taken up for description.

Figure 18:
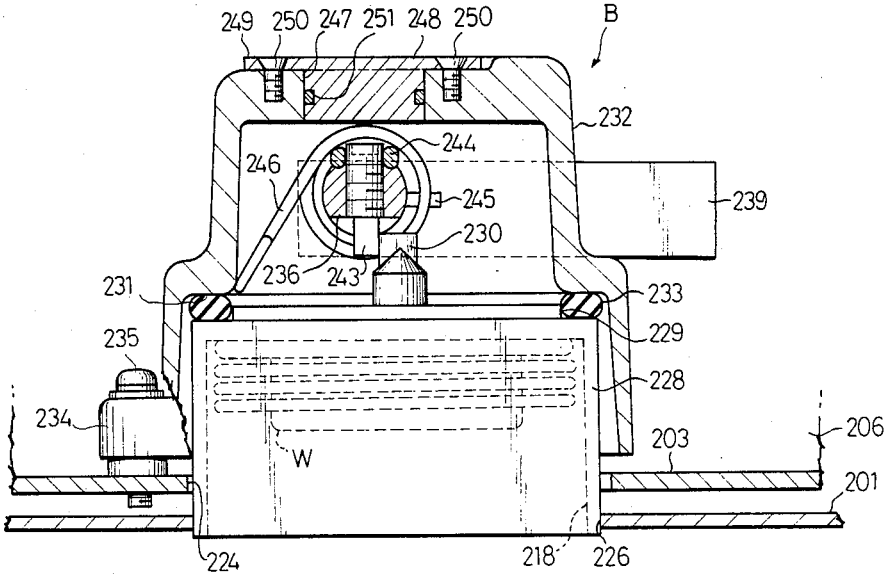

As shown in FIG. 18, a covered cylindrical bellows case 228 is fixed hermetically in a hole 226 formed in an upper wall of the body case 201 at the lower end thereof, and its upper end portion protrudes into the enclosing box 206 through an opening 224 of the support plate 203. A stepped part 229 is formed on an outer periphery of the top of the bellows case 228. There is provided a hollow zone 218 communicating with the body case 201 internally in the bellows case 228, and a metallic bellows W expandable according to a fluctuation of a gas pressure in the body case 201 is accommodated in the hollow zone 218. An operating rod 230 provided on a moving part of the bellows W protrudes upward through a hole 217 (FIG. 19) formed in an upper wall of the bellows case 228.

An outside of the bellows case 228 is covered with a covered cylindrical cover 232. An O-ring 233 is interposed between a stepped part 231 of the cover 232 and the stepped part 229 of the bellows case 228. A plurality of mounting areas 234 are provided projectingly outward on a lower end of the cover 232, and the cover 232 is mounted on the support plate 203 through a screw 235 at the mounting areas 234. In such mounted state, the O-ring 233 is pressed between the cover 232 and the bellows case 228, and thus a space in an upper portion of the cover 232 is kept airtight.

Figure 17:
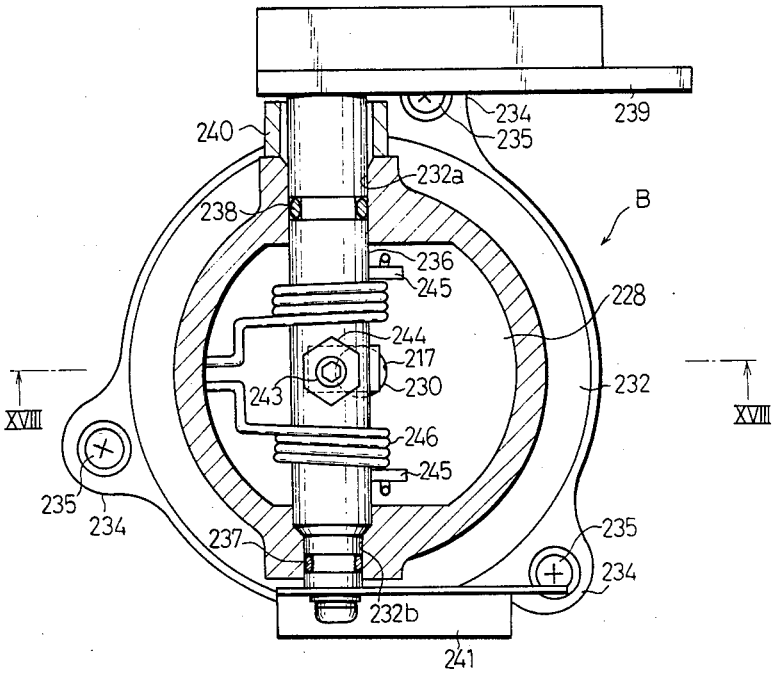

As shown in FIG. 17 and FIG. 18, a pair of bearing holes **232*a*, 232*b* opposite each other are perforated in a circumferential wall of the cover 232 over the bellows case 228, and a turning shaft 236 is laid between both the bearing holes 232*a*, 232*b*. O-rings 237, 238 for airtight application are interposed between the bearing holes 232*a*, 232*b* of the cover 232 and both end portions of the turning shaft 236**.

A locking member 239 is fixed on a rear projecting end portion (upper part in FIG. 17) of the turning shaft 236 at the outside of the cover 232. The locking member 239 is disposed at a working position indicated in FIG. 19 and also at an inoperative position indicated in FIGS. 14 and 18 according to a reciprocation of the turning shaft 236. When the locking member 239 is erected at the working position, the upper end portion comes on a turning path of the engaging projection 227 of the driven lever 213, thus preventing the driven lever 213 from turning in one way. Then, a sleeve 240 is fitted on the turning shaft 236 between the locking member 239 and the cover 232.

Figure 19:
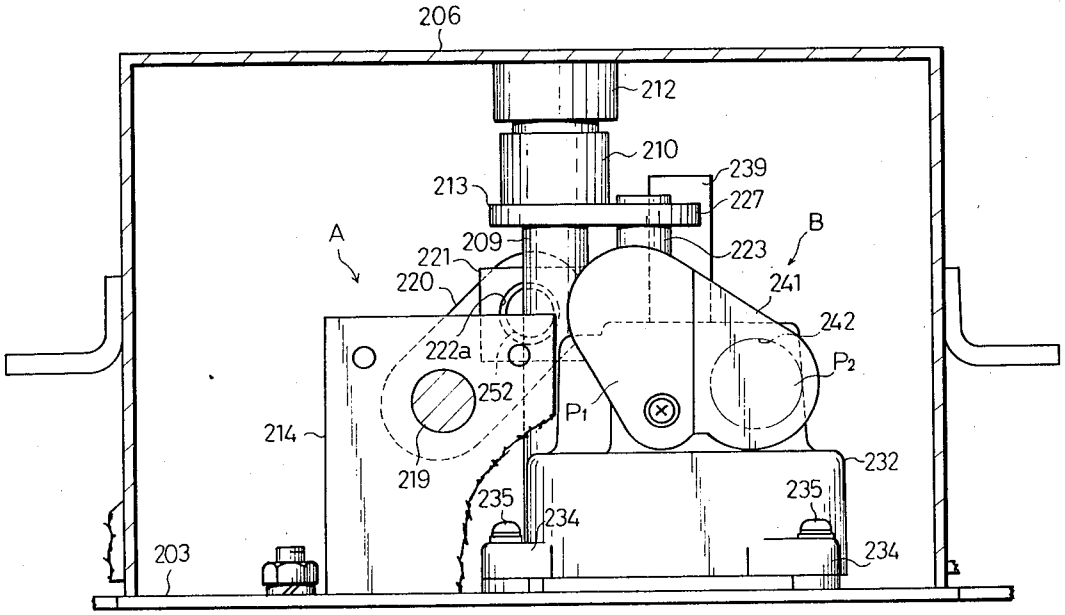

A display panel 241 is fixed on a forward projecting end of the turning shaft 236 at the outside of the cover 232 so as to be opposite near to the inside of a front wall of the enclosing box 206. As shown in FIG. 14 and FIG. 19, a display color P1 indicating an unlocked state is applied on the front of one side of the display panel 241, and also a display color P2 (red for example) indicating a locked state is applied on the front of another side. Then, as shown in FIG. 14, when the locking member 239 is disposed at an inoperative position, a display hole 242 perforated in a front wall of the enclosing box 206 and the one display color P1 are opposite each other, and as shown in FIG. 19, when the locking member 239 is disposed at a working position, the display hole 242 and the display color P2 indicating a locked state are opposite each other.

As shown in FIG. 17 and FIG. 18, a threaded pin 243 provided with a hexagon hole on the upper end surface is screwed in the turning shaft 236 almost at the central portion. A lower end projection of the pin 243 engages with the actuating rod 230 of the contracted bellows W sidewise. A locking nut 244 is screwed in an upper end projection of the pin 243. A rate of the lower end projection of the threaded pin 243 engaging with the actuating rod 230 protruded most upward is adjusted by turning the pin 243. Accordingly, a gas pressure in the body case 201 when the threaded pin 243 is disengaged with the actuating rod 230 can be set to any selected value beforehand.

A helical double torsion spring 246 is installed on the turning shaft 236 in an upper space of the cover 232, both the ends are locked by a pair of locking pins 245 on the turning shaft 236, the central portion is locked on the inside of a circumferential wall of the cover 232, and thus the turning shaft 236 is energized counterclockwise of FIG. 18 at all times by the spring force.

A through hole 247 is formed in the upper wall center of the cover 232 so as to be opposite to the threaded pin 243 from over. A tight plug 248 is fitted in the through hole 247 through an O-ring 251, and a flange 249 is locked on the top of the cover 232 through a plurality of screws 250. The threaded pin 243 will be adjusted by demounting the tight plug 248.

An action of the gas switch constituted as above will now be described.

FIG. 14 and FIG. 16 represent the state wherein a gas pressure in the body case 201 is normal and the actuating mechanism A is ready for operation. When the gas pressure is normal, the display color P1 indicating an unlocked state in the display panel 241 can be ensured externally through the display hole 242.

When the gas pressure in the body case 201 comes lower than a predetermined value in the state where the actuating mechanism A is closed, the bellows W is elongated according to a difference between an internal pressure of the cover 232 and an internal pressure of the body case 201, and the actuating rod 230 shifts downward in FIG. 18. Then, the actuating rod 230 is disengaged from the threaded pin 243, and the turning shaft 236 is turned counterclockwise in the drawing on a force energized by the torsion spring 246.

In accordance with a rotation of the turning shaft 236, the locking member 239 is erected and turned at a working position indicated in FIG. 19, and its upper end portion is disposed on a turning path of the engaging projection 227 of the driven lever 213. Accordingly, the driven lever 213 is prevented from turning clockwise in FIG. 15 by the locking member 239, and thus the control handle 225 cannot be turned in an opening direction (clockwise of FIG. 14). Further, in accordance with a rotation of the turning shaft 236 in the locking direction, the other display color P2 of the display panel 241 is opposite to the display hole 242 as shown in FIG. 19. Accordingly, the operator is capable easily of ensuring the display color P2 indicating a locked state externally through the display hole 242.

Then, quite different from the case mentioned above, when a gas pressure in the body case 201 drops where the actuating mechanism A is kept open, the locking member 239 is erected and turned at a working position to be located on a turning path of the engaging projection 227 (position indicated by a chain line of FIG. 15) on the side counter to that in which the locking member 239 is closed, so that the lock-member 239 is prevented from turning counterclockwise in FIG. 15, and thus the control handle 225 cannot be operated in a closing direction.

In the invention, the bellows W operates according to a difference between an internal pressure of the cover 232 and an internal pressure of the body case 201. The cover 232 is mounted hermetically to the bellows case 228 and thus a difference in temperature between the body case 201 and the cover 232 is very slight, therefore a variation of internal pressure of the cover 232 to a temperature change and a variation of internal pressure of the body case 201 become almost equal. Accordingly, an interlocking relation between the actuating mechanism A and the locking mechanism B adjusted beforehand at the time of assembling is not capable of being disordered by a temperature change at the time of operation.

(Fifth Example)

Figure 20:
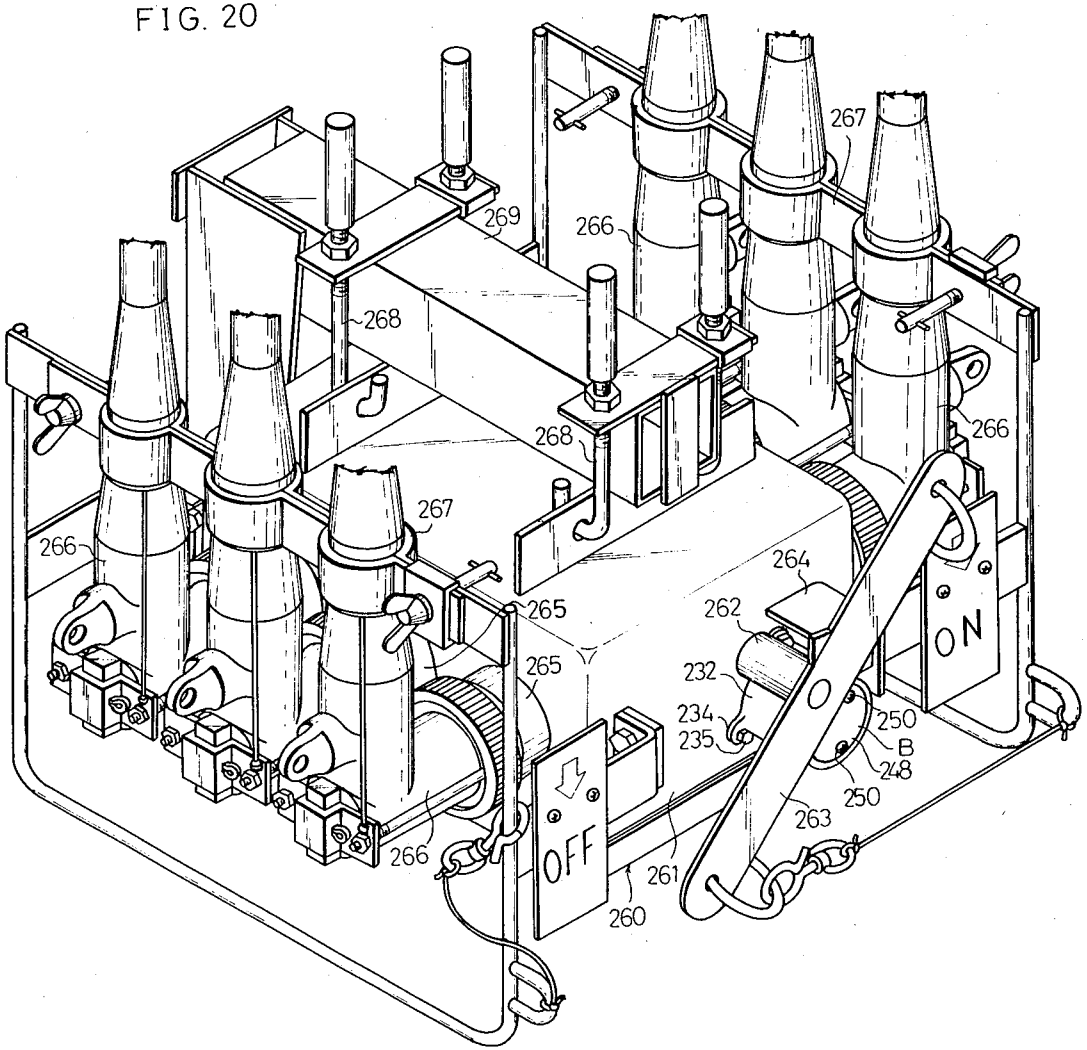
Figure 21:
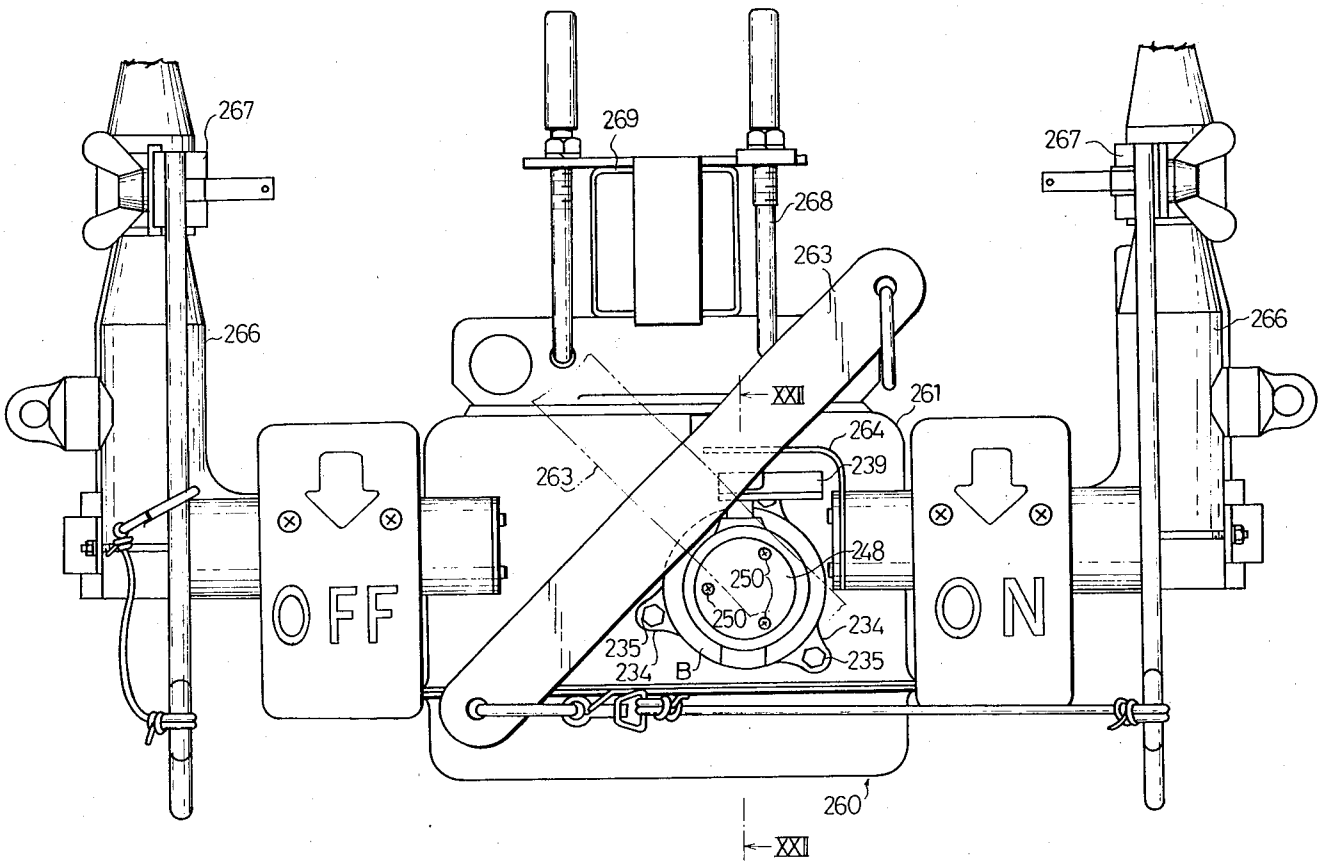
Figure 22:
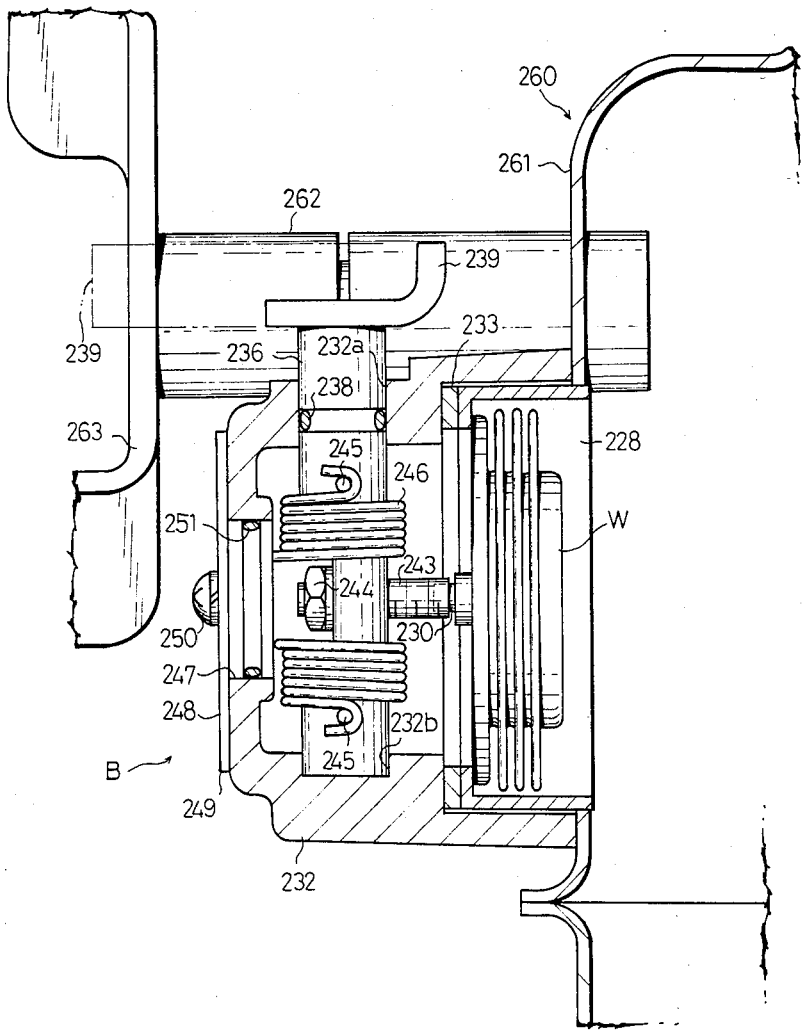

Next, a fifth example of the invention wherein a gas switch for construction work is equipped with the system of the above-described fourth example will be described according to FIG. 20 to FIG. 22. Then, like reference numbers represent like or equivalent constructions in the fourth example, and no particular description will be given thereof.

A control handle 263 is mounted through an operating shaft 262 in front of one side of a switch 260 for construction work with three phases arranged horizontally thereon. The locking mechanism B almost the same in construction as the fourth example is installed on the front of a body case 261 near the control handle 263. When a gas pressure in the body case 261 drops, a nose of the locking member 239 protrudes forward according to a rotation of the turning shaft 236, as indicated by a chain line in FIG. 22, and is disposed on a turning path of the control handle 263.

The locking mechanism B of the example is different from the locking mechanism B of the fourth example described hereinbefore in the respect described next. The one bearing hole **232*b* of the cover 232 is closed outside. An L-shaped covering member 264 corresponding to the enclosing box 206 of the fourth example is fixed on an outside of the body case 261** so as to cover the locking mechanism B over and at one side.

A plurality of bushings 265 are provided projectingly on the outside of both sides of the switch 260 separately by phase, and an L-shaped connector 266 is connected to each bushings 265. An upper end of the connector 266 is supported on the body case 261 through a bracket 267. An arm member 269 for mounting the body case 261 on a power pole and others is provided demountably on an upper portion of the switch 260 through a plurality of support fittings 268.

In the example, since the locking mechanism B is provided externally of the body case 261, a locked state can be ensured according to the locking member 239 protruded and turned forward at the time of gas pressure drop. Other working effects in the fifth example are similar to the fourth example described above.

As many widely different embodiments of the invention may be made without departing from the spirit and scope thereof, it is to be understood that the invention is not limited to the specific embodiments thereof except as defined in the appended claims.

What is claimed is:

1. A switch containing an arc-extinguishing gas, comprising:

a body case, at least one switching unit disposed in the body case, an arc-extinguishing gas retained in the body case at a predetermined pressure so that when the switching unit is actuated, an arc does not occur inside the body case, a case member installed otuside the body case, an actuating mechanism connected to the switching unit for operating the switching unit, said actuating mechanism being situated outside the body case, a lock member shiftably connected to the case member, said lock member, when shifted to a working position, engaging the actuating mechanism to prevent shifting of the switching unit, an operating device connected to the case member for detecting pressure of the arc-extinguishing gas in the body case and shifting the lock member to the working position when pressure of the arc-extinguishing gas in the body case becomes lower than a predetermined value, and a display member situated outside the body case for displaying whether pressure of the arc-extinguishing gas in the body case is lower than a predetermined value in response to actuation of the operating device.

2. The switch as defined in claim 1, wherein said case member comprises a guide member for linearly guiding the lock member, and a support member for linearly supporting the display member along the direction in which the lock member shifts.

3. The switch as defined in claim 1, wherein said case member comprises a guide member for linearly guiding the lock member, and a bearing member for rotatably supporting the display member.

4. The switch as defined in claim 1, wherein said case member comprises a journaling member for rotatably supporting the lock member and the display member.

5. The switch as defined in claim 1, wherein said operating device comprises a metallic bellows provided in the body case, said bellows being expandable in response to a change in pressure of the arc-extinguishing gas, and an actuating rod situated in the case member and having a base end coupled to the bellows and a nose for shifting in response to an expansion of the bellows to disengage from the lock member.

6. The switch as defined in claim 5, wherein said operating device further comprises an adjusting member for adjusting a rate of engagement of the actuating rod with the lock member, said adjusting member being situated between the actuating rod and the lock member.

7. A switch containing an arc-extinguishing gas comprising:

a body case, at least one switching unit disposed in the body case, an arc-extinguishing gas retained in the body case at a predetermined pressure so that when the switching unit is actuated, an arc does not occur inside the body case, a control handle mounted outside the body case and connected to the switching unit for operating the switching unit, an indicator connected to the control handle for indicating an on-off state of the switching unit, said indicator being situated outside the body case, a case member installed outside outside the body case and having a through hole, a display plug detachably mounted in the through hole of the case member, a bellows sitauted in the body case, said bellows expanding and contracting according to a change in pressure of the arc-extinguishing gas, an operating member situated in the case member and engaging the bellows for movement in response to expansion of the bellows, a lock member slidably situated in the case member for disengaging from the operating member and projecting toward the display plug to push the display plug out of the through hole in response to movement of the bellows due to a pressure decrease of the arc-extinguishing gas to a predetermined value, whereby the lock member is located in a working position adjacent the indicatior to prevent shifting of the control handle by engaging the indicator.

8. The switch as defined in claim 7, further comprising a cylindrical member installed on the case member and having the through hole therein.

9. The switch as defined in claim 8, wherein said cylindrical member is provided on an end surface thereof facing sisd lock member with a closing rubber film breakable in response to a shift of the lock member to the working position.

10. The switch as defined in claim 7, wherein said lock member comprises:

a guide cylinder fixed within said case member and extending along a straight line passing almost centrally through the through hole;

a locking bar inserted slidably in the guide cylinder; and a spring for constantly urging the locking bar toward the through hole.

11. The switch as defined in claim 10, further comprising an engaging member situated between the operating member and the locking bar, said engaging member being shiftable between a position engaging with the locking bar and a position disengaging from the locking bar in response to a shift of the operating member due to a gas pressure drop.

12. The switch as defined in claim 11, further comprising an adjusting member situated between the engaging member and the operating member, for adjusting and setting a rate of shift of the operating member when the engaging member is disengaged from the locking bar by changing a rate of engagement of the engaging member with the locking bar.

13. A switch containing an arc-extinguishing gas comprising:

a body case, at least one switching unit disposed in the body case, an arc-extinguishing gas retained in the body case at a predetermined pressure so that when the switching unit is actuated, an arc does not occur inside the body case, an actuating mechanism connected to the switching unit for operating the switching unit, said actuating mechanism being situated outside the body case.

a case member installed outside the body case, a bellows situated in the body case, said bellows expanding and contracting in response to a change in pressure of the arc-extinguishing gas, an operating member situated in the case member and engaging the bellows for movement in response to expansion of the bellows, a lock member slidably sitauted in the case member for shifting to a working position to engage with the actuating mechanism to prevent shifting of the switching unit when the bellows moves in response to a pressure decrease of the arc-extinguishing gas to a predetermined value, a cylindrical member mounted outside the case member adjacent the lock member, and a shutter member connected to the lock member, said shutter member being located in the cylindrical member when the lock member is in a non-working position and outside the cylindrical member when the lock member is in the working position.

14. The switch as defined in claim 13 further comprising airtight packings provided between the cylindrical memberand the case member and also between the case member and the body case.

15. The switch as defined in claim 13, wherein said case member is provided with a detector for detecting the working position of the lock member.

16. The switch as defined in claim 13, wherein said lock member comprises:

a locking bar extending in a direction orthogonal to the direction in which the operating member moves;

a spring attached to the locking bar for constantly urging the locking bar toward the working position; and an engaging member provided on the locking bar for engaging with the operating member when the gas pressure is above a predetermined value and disengaging from the operating member in response to a shift of the oprating member due to a gas pressure drop, thereby releasing an energizing force of the spring to move the lock bar.

17. The switch as defined in claim 16, wherein said engaging member comprises an eccentric ring adjustably turnable relative to the locking bar, an engaging rate of the eccentric ring with the operating member being adjustable by changing a position of the eccentric ring in relation to the locking bar.

18. A switch containing an arc-extinguishing gas comprising:

a body case, at least one switching unit disposed in the body case, an arc-extinguishing gas retained in the body case at a predetermined pressure so that when the switching unit is actuated, an arc does not occur inside the body case, an actuating mechanism connected to the switching unit for operating the switching unit, said actuating mechanism being situated outside the body case, a bellows situated in the body case, said bellows expanding and contracting in response to a change in pressure of the arc-extinguishing gas, a cover member mounted outside the body case adjacent the bellows, an operating member situated in the cover member and engaging the bellows for movement in response to expansion of the bellows, a rotatable shaft rotatably situated in the cover member and having an engaging part to engage with the operating member, a spring member attached to the rotatably shaft for urging the rotatable shaft to rotate in one direction, and a lock member connected to the rotatably shaft and situated outside the cover member, said lock member, when the bellows moves due to a pressure decrease of the arc-extinguishing gas to a predetermined value to thereby rotate the rotatable shaft, moving to a working position to prevent movement of the actuating mechanism.

19. The switch as defined in claim 18, further comprising a display positioned externally of the cover member and connected to said rotatable shaft for rotating therewith.

20. The switch as defined in claim 19, wherein said body case includes a case member covering the cover member and a through hole located at a pposition opposite the dispaly, said display having a pair of different display colors on a surface opposite the through hole, one of the display colors being exposed externally of the case member through the through hole in response to a rotation of said rotating shaft.

21. The switch as defined in claim 18, wherein said rotatable shaft engaging part comprises an adjusting piece adjustable for positioning in a direction orthogonal to an axis of the rotatable shaft, an engaging rate of the adjusting piece with the operating member being adjustable by adjustable by adjusting a position of the adjusting piece in relation to the rotating shaft.

22. The switch as defined in claim 21, wherein said cover member includes a removable leakproof plug located on an outside wall of said cover member opposite the adjusting piece.

23. The switch as defined in claim 18, wherein said actuating mechanism comprises:

an operating handle operated manually between opening and closing positions of the switching unit; and a turning member connected to the operating handle, said turning member being able to move to a position engasging with the lock member for locking the operating handle in the opening or closing position of the switching unit.

24. The switch as defined in claim 23, wherein said actuating mechanism further comprises:

an operating shaft having one end mounted to the operating handle and supported rotatably outside the body case to extend parallel with one side of the body case;

a driving shaft supported rottably on the body case to extend orthogonally in relation to the operating shaft, said driving shaft having one end coupled to the switching unit and another end mounted to the turning member; and a transfer member for transferring rotation of the operating shaft to the driving shaft in response to operation of the operating handle.

25. A switch containing an arc-extinguishing gas comprising:

a body case, at least one switching unit disposed in the body case, an arc-extinguishing gas retained in the body case at a predetermined pressure so that when the switching unit is actuated, an arc does not occur inside the body case, an actuating mechanism connected to the switching unit for operating the switching unit, said actuating mechanism being situated outside the body case, a bellows situated in the body case, said bellows expanding and contracting in response to a change in pressure of the arc-extinguishing gas, a cover member mounted outside the body case adjacent the bellows, a case member situated outside the body case for covering the cover member, an operating member situated in the cover member and engaging the bellows for movement in response to expansion of the bellows, a rotatable shaft rotatably situated in the cover member and having end portions projecting outside the cover member and an engaging part to engage with the operating member, a spring member attached to the rotatable shaft for urging the rotatable shaft to rotate in one direction, a lock member connected to the rotatable shaft and situated outside the cover member, said spring member rotating said rotatable shaft to move said lock member to a working position to thereby prevent movement of the actuating mechanism when the bellows moves in response to a pressure decrease of the arc-extinguishing gas to a predetermined value, a display connected to the rotatable shaft at an end opposite the lock member and having a display color thereon for showing the working position of the lock member, and a through hole formed in the case member at a position opposite the display for showing the working position through the through hole.

26. The switch as defined in claim 25, wherein said body case includes a covered cylindrical case having a projection for enclosing the bellows therein and projecting into the case member and a cover part, said cover member surrounding the projection of the cylindrical case and forming a space externally of the cover part of the cylindrical case for acommodating said rotatable shaft.

* * * * *